US008206192B2

(12) United States Patent
Shiomi et al.

(10) Patent No.: US 8,206,192 B2
(45) **Date of Patent: *Jun. 26, 2012**

(54) BOAT PROPULSION ENGINE

(75) Inventors: Kazuyuki Shiomi, Wako (JP); Tetsuro Ikeno, Wako (JP); Takeshi Okada, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 346 days.

This patent is subject to a terminal disclaimer.

(21) Appl. No.: 12/064,571

(22) PCT Filed: Aug. 18, 2006

(86) PCT No.: PCT/JP2006/316662

§ 371 (c)(1),
(2), (4) Date: Feb. 22, 2008

(87) PCT Pub. No.: WO2007/023926

PCT Pub. Date: Mar. 1, 2007

(65) Prior Publication Data

US 2009/0149090 A1 Jun. 11, 2009

(30) Foreign Application Priority Data

Aug. 22, 2005 (JP) ..... 2005-240066

(51) Int. Cl.

| | |
|---|---|
| ***B63H 20/00*** | (2006.01) |
| ***B63H 20/32*** | (2006.01) |
| ***B63H 20/34*** | (2006.01) |
| ***B63B 1/16*** | (2006.01) |
| ***B63B 1/24*** | (2006.01) |

(52) U.S. Cl. ..... 440/76; 440/66

(58) Field of Classification Search ..... 440/76–78, 440/53, 66, 111, 112; 114/274, 284–287
See application file for complete search history.

(56) References Cited

U.S. PATENT DOCUMENTS

| | | | | |
|---|---|---|---|---|
| 1,737,180 | A * | 11/1929 | Willis | 440/53 |
| 2,674,119 | A | 9/1956 | Sigler | |
| 2,764,119 | A | 9/1956 | Sigler | |
| 2,860,594 | A * | 11/1958 | Kiekhaefer | 440/66 |
| 2,963,000 | A * | 12/1960 | Fester | 440/71 |
| 3,019,755 | A * | 2/1962 | Diamond | 114/274 |
| 3,118,411 | A * | 1/1964 | Koriagin | 114/273 |
| 3,153,397 | A * | 10/1964 | Mattson et al. | 440/76 |
| 3,213,822 | A * | 10/1965 | Sawchuk | 114/55.56 |
| 3,408,975 | A * | 11/1968 | Gamble | 440/40 |

(Continued)

FOREIGN PATENT DOCUMENTS

CA 2219750 A * 4/1999

(Continued)

OTHER PUBLICATIONS

Search Report dated Nov. 27, 2006 issued in corresponding PCT Application No. PCT/JP2006/316662.

(Continued)

*Primary Examiner* — Ajay Vasudeva
(74) *Attorney, Agent, or Firm* — Westerman, Hattori, Daniels & Adrian, LLP

(57) ABSTRACT

A boat propulsion engine includes a buoyant member (20) disposed on a case body that houses a drive shaft (47) in order to lift the stern. The buoyant member has a lower surface (32) that slopes downward in the rearward direction.

14 Claims, 10 Drawing Sheets

U.S. PATENT DOCUMENTS

| | | | | |
|---|---|---|---|---|
| 3,442,246 | A * | 5/1969 | Paolone | 114/55.55 |
| 3,718,111 | A * | 2/1973 | Del Vecchio | 114/55.5 |
| 4,995,840 | A | 2/1991 | Seale et al. | |
| 5,005,506 | A * | 4/1991 | Handmer | 114/55.53 |
| 5,184,563 | A * | 2/1993 | Hislop | 114/251 |
| 5,370,564 | A | 12/1994 | Fujimoto et al. | |
| 6,875,066 | B2 * | 4/2005 | Wolaver | 440/77 |
| 7,189,127 | B2 * | 3/2007 | Otobe et al. | 440/53 |
| 7,322,866 | B2 * | 1/2008 | Shiomi et al. | 440/76 |
| 7,485,019 | B1 * | 2/2009 | Macier et al. | 440/76 |
| 7,845,997 | B2 * | 12/2010 | Shiomi et al. | 440/53 |
| 7,987,804 | B2 * | 8/2011 | Shiomi et al. | 114/274 |
| 2005/0042437 | A1 * | 2/2005 | Ramesh et al. | 428/304.4 |

FOREIGN PATENT DOCUMENTS

| | | | |
|---|---|---|---|
| DE | 1291249 | B | 3/1969 |
| DE | 1756174 | A1 | 9/1970 |
| FR | 2617796 | A1 * | 1/1989 |
| JP | 47-9194 | | 2/1971 |
| JP | 47-9194 | U | 10/1972 |
| JP | 56008786 | A * | 1/1981 |
| JP | 62-139781 | A | 6/1987 |
| JP | 05270489 | A * | 10/1993 |
| JP | 05278673 | A * | 10/1993 |
| JP | 5-319386 | | 12/1993 |
| JP | 05-319386 | A | 12/1993 |
| JP | 09156586 | A * | 6/1997 |

OTHER PUBLICATIONS

International Search Report of PCT/JP2006/316663, date of mailing Nov. 27, 2006.

English Translation of Chinese Office Action dated May 22, 2009, issued in corresponding Chinese Patent Application No. 2006-80030548.4.

Office Action dated Oct. 14, 2010, issued in corresponding U.S. Appl. No. 12/064,569.

Office Action dated Mar. 14, 2011, issued in corresponding U.S. Appl. No. 12/064,569.

Office Action dated Jun. 17, 2010, issued in corresponding U.S. Appl. No. 12/064,569.

* cited by examiner

BOAT PROPULSION ENGINE

TECHNICAL FIELD

The present invention relates to a boat propulsion engine, often called an inboard-engine outboard-drive unit. More particularly, it relates to such a boat propulsion engine having a buoyant member so as to lift a stern of the boat upward to allow the boat to start moving smoothly from its standstill position.

BACKGROUND ART

In a boat that moves by use of a boat propulsion engine which comprises an outboard motor, the level of the stern drops and sinks into the water, and the bow rises and is tilted upward when, for example, the boat is at a standstill and when the boat begins to move. Since the hull therefore begins to move in a tilted state, the water resistance is considerable when traveling starts, and adequate boat speed cannot be obtained. The stern must rise upward a certain amount, and the orientation of the boat must become approximately horizontal in order to reach a certain level of speed. There is a problem in that time is required for the boat to approximate an orientation that is nearly horizontal, and the boat cannot smoothly accelerate.

An outboard engine that can improve the acceleration characteristics of a boat is disclosed in Japanese Patent Laid-Open Publication No. 5-319386 (JP-5-319386A) and Japanese Utility Model Laid-Open Publication No. 47-9194 (JP-UM-47-9194A).

In the outboard engine of the 5-319386 publication, an engine, a vertically disposed drive shaft and other drive components, and transmission components are covered by a vertical cowling. A propulsion casing is disposed below the lower cowling so as to provide vertical linkage. When the boat is at a standstill, a portion of the lower cowling is submerged, and when the boat is moving, only the propulsion casing is submerged.

In the outboard engine of the 47-9194 publication, the waterproof engine casing that covers the engine is formed having a size that is sufficient to provide flotation to the engine, and the engine is designed to float on the surface of the water.

In the outboard engine of the 5-319386 publication, however, a portion of the lower cowling that forms the engine room is structured to submerge, and it is therefore difficult to endow this structure with water tightness when the lower cowling is assembled. When water has furthermore flooded the engine room, it is difficult to drain the water, the movement of movable components is compromised by water and salt, and the components tend to corrode.

The outboard engine mounted on the stern moreover has a structure in which the engine is covered with an upper and lower cowling, an extension case is provided below the lower cowling, and a gear case is disposed under the extension case. Therefore, the driving noise of the engine passes through the case and the cowlings, and is released to the periphery as engine noise.

In the outboard motor of the 5-319386 publication, the buoyancy of the hull itself only prevents the stern from sinking when the boat accelerates from a standstill in particular, and the design does not provide for actively lifting the stern and quickly bringing the hull into a horizontal state.

Thus, the depth of the outboard engine when the boat is at a standstill or is accelerating must be reduced, the orientation of the hull must be made to rapidly transition to an approximately horizontal state during acceleration, and smooth acceleration must be achieved.

DISCLOSURE OF THE INVENTION

According to a first aspect of the present invention, there is provided a boat propulsion engine which comprises a case body for housing a drive shaft that drives a propeller, and a buoyant member which is disposed on the case body and a portion of which has a surface that slopes downward in a rearward direction.

The sinking depth of the stern is reduced by the buoyant member when the boat is at a standstill or moving at low speed, and the tilting of the hull is corrected so as to be nearly horizontal. The buoyancy and the more proximal horizontal orientation of the hull (for overcoming a hump or bow waves) resists and reduces further sinking during acceleration when the boat accelerates (first half of the acceleration stage) from a standstill or low speed travel. The lower surface of the buoyant member slopes downward in the rearward direction, thereby providing advantages in that lift is produced by the resistance of the sloped surface, the time required for the boat to overcome bow waves during acceleration can be shortened, and smooth acceleration can be achieved. Therefore, retrofitting and integration with the boat propulsion engine can furthermore be simplified because the buoyant member has buoyancy and lifting function.

In the present example, the sloped surface is preferably formed on the lower surface of a rear portion of the buoyant member.

The boat propulsion engine described above preferably further comprises an anti-cavitation plate disposed above the propeller, wherein the sloped surface is disposed above and at a distance from the anti-cavitation plate. Therefore, when rearward sinking is not required in the first half of the acceleration stage, the rear end portion of the lower surface of the buoyant member does not make contact with the water and can therefore avoid becoming a resistance during travel. After acceleration, the buoyant member rises above the waterline, and therefore does not form a resistance in the water during travel, and high speed maneuverability is not compromised.

According to a second aspect of the present invention, there is provided a boat propulsion engine that comprises an anti-cavitation plate disposed above a propeller, a case body for housing a drive shaft that drives the propeller, and a buoyant member which is, disposed on the case body and which has a lower surface that is further above the anti-cavitation plate and that is wider than the anti-cavitation plate.

First, the depth of the stern is reduced by the buoyant member when the boat is at a stand still or moving at low speed, and the tilting of the hull is corrected so as to be nearly horizontal. The buoyancy and the more proximal horizontal orientation of the hull (orientation for overcoming bow waves) resists and reduces further sinking during acceleration when the boat accelerates (first half of the acceleration stage) from a standstill or low-speed travel, and smooth acceleration can be achieved.

Also, in the boat propulsion engine, the downward-facing surface that is wider than the anti-cavitation plate of the buoyant member effectively reduces the upward splashing of water, i.e., the upward spewing of water caused by the rotation of the propeller.

Integral moldings and after-mountings on the boat propulsion engine can furthermore be simplified because the engine also has two functions, i.e., a buoyancy function and an anti-splash function.

The lower surface of the buoyant member preferably has an extended portion that extends further forward than a front end portion of the case body. The lower surface of the buoyant member therefore extends forward from the drive shaft case, and splashing in the upward direction can be effectively reduced.

BRIEF DESCRIPTION OF THE DRAWINGS

Certain preferred embodiments of the present invention will be described in detail below, by way of example only, with reference to the accompanying drawings, in which.

BEST MODE FOR CARRYING OUT THE INVENTION

Referring now to FIGS. 1 to 6 inclusive, description will be made as to a boat propulsion engine or an inboard-engine outboard-drive unit, according to a first embodiment of the present invention. The boat propulsion engine in this embodiment is referred to simply as an outboard motor.

Figure 1:
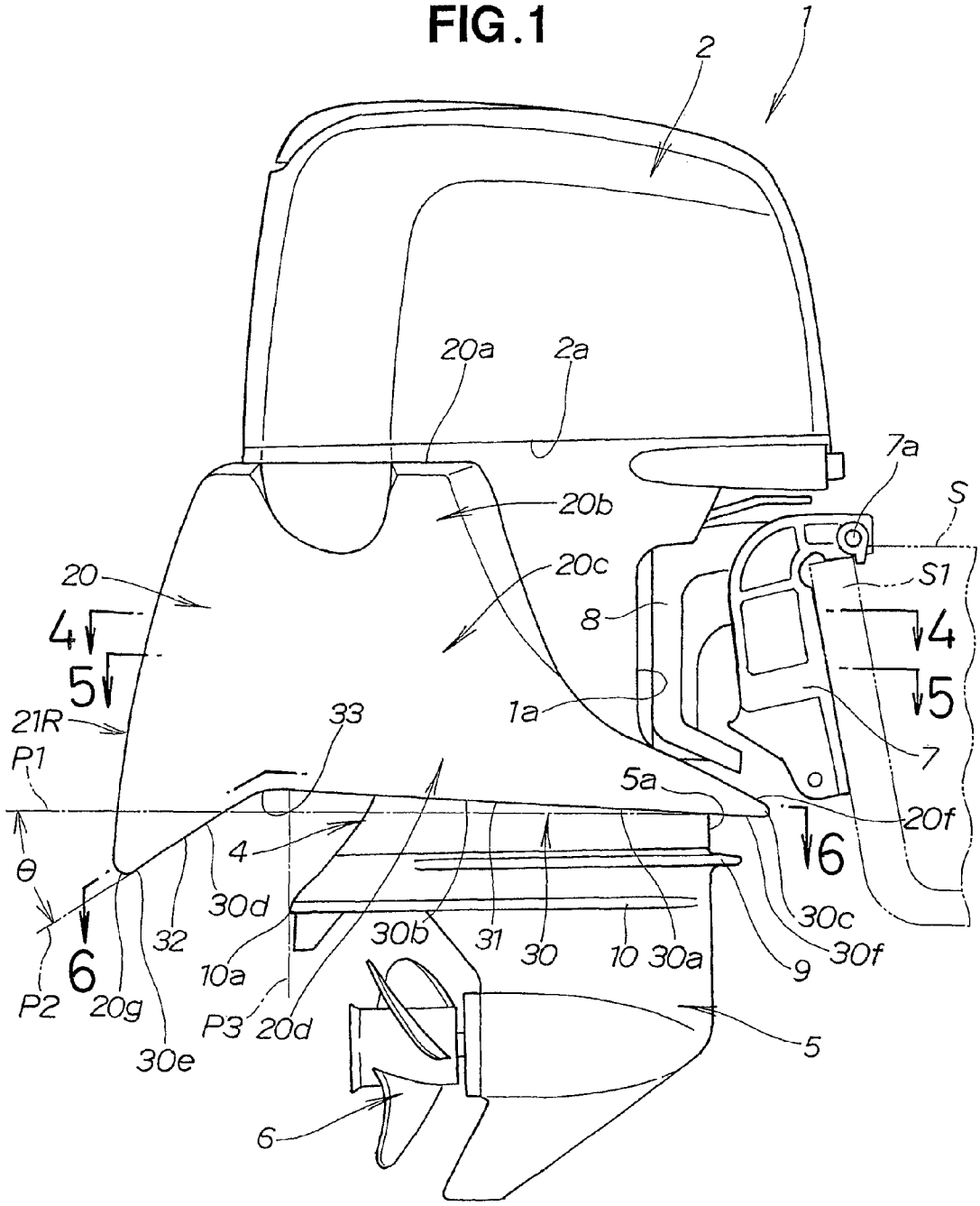
FIG. 1 is a side view of a boat propulsion engine according to a first embodiment of the present invention.
Figure 2:
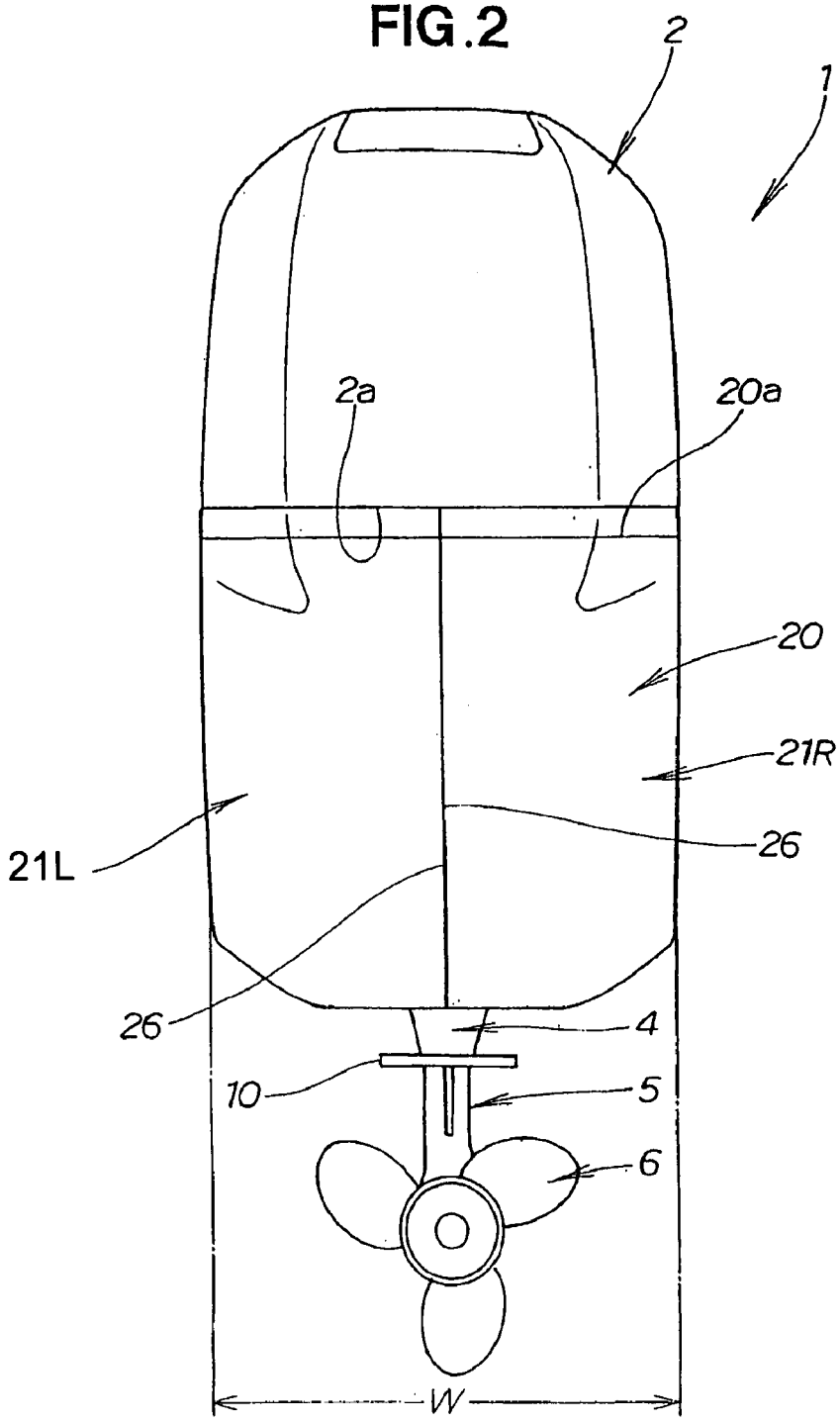
FIG. 2 is a rear view of the outboard engine shown in FIG. 1.
Figure 3:
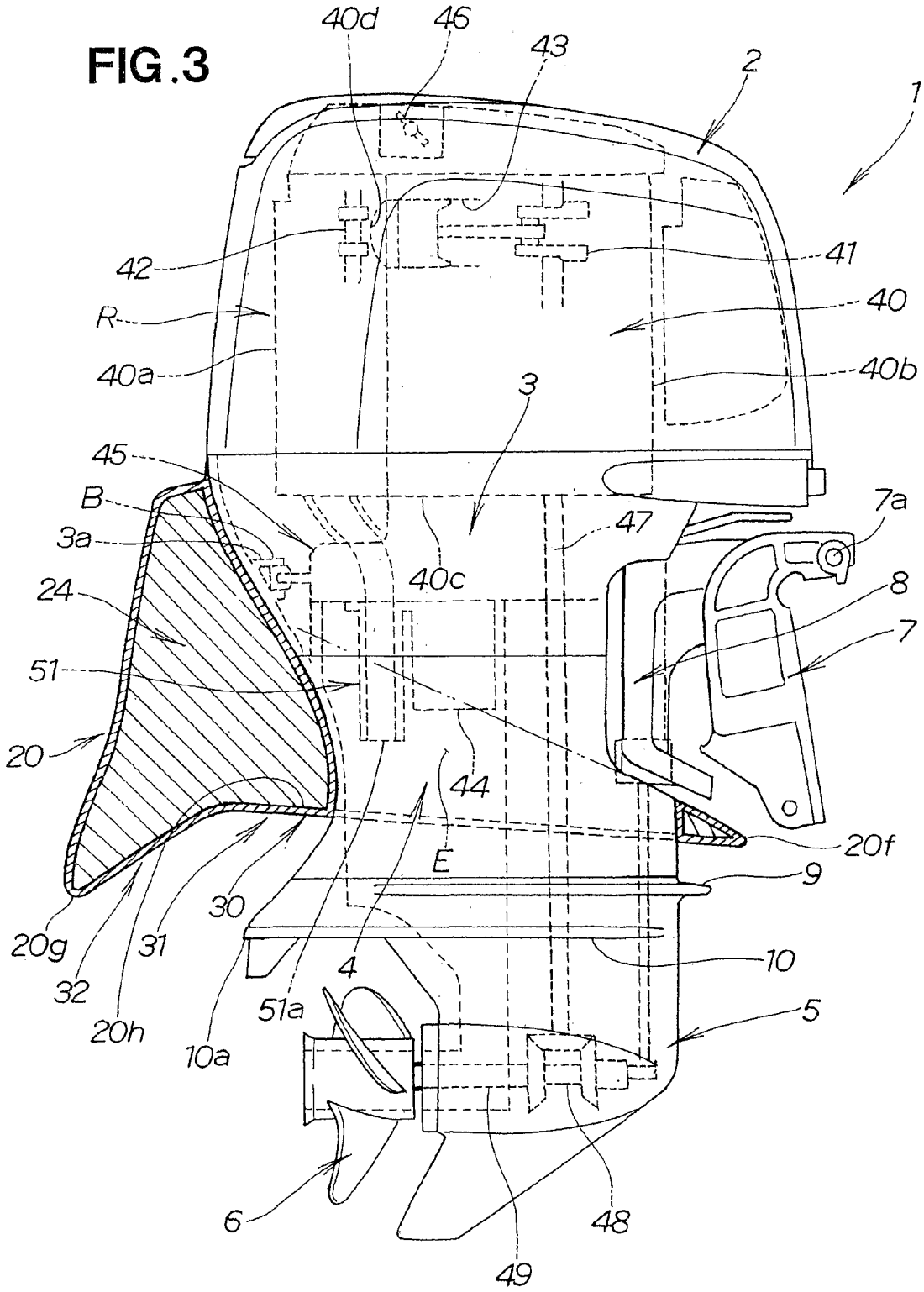
FIG. 3 is a cross-sectional view of the outboard engine shown in FIG. 1.

The outboard engine 1 has a engine cover (top cover) 2 that covers the upper half of an engine (power source) 40, and an undercover 3 that covers the lower half of the engine 40, as shown in FIGS. 1, 2, and 3. An engine room R is formed by the engine cover 2 and undercover 3. An extension case (leg body) 4, which is a drive shaft case, is disposed below the under-cover 3. A gear case 5 having a propeller 6 for propulsion is disposed below the extension case 4.

A concavity 1*a* that is concave in the rearward direction of the outboard engine 1 is formed on the front portion of the extension case 4. The outboard engine 1 is mounted on the stern S1 of the hull S by way of a stern bracket 7. The stern bracket 7 is mounted on the concavity 1*a*. A swivel case 8 rotatably supports the outboard engine 1 in the horizontal direction. The outboard engine 1 furthermore swings vertically about a tilt shaft 7*a* mounted on the stern bracket 7.

An anti-splash plate 9 is formed on the upper external peripheral portion of the gear case 5. An anti-cavitation plate 10 extending so as to protrude from behind the propeller 6 is formed on the external periphery of the gear case 5 below the anti-splash plate 9.

The engine 40 is a vertical engine in which a crankshaft 41 and a cam shaft 42 are vertical, as shown in FIG. 3. The engine 40 is accommodated in an engine room R formed by the engine cover 2. The engine 40 is a multi-cylinder four-stroke engine in which a plurality of horizontally disposed cylinders 30 is arrayed in the vertical direction.

The engine 40 has an engine head 40*a* disposed in the rearward position of the outboard engine 1, and an engine main body 40*b* positioned in the longitudinally intermediate portion of the outboard engine 1. The engine head 40*a* includes a cylinder head and a head cover. The engine main body 40*b* includes a cylinder block and a crank case. The undercover 3 covers a bottom portion 40*c*, which is the lower portion of the engine cover 2. A mounting case 45 is disposed inside the undercover 3 and is used to house an oil pan 44.

A throttle valve 46 is part of an air intake device.

A drive shaft 47 passes vertically through the interior of the mounting case 45, extension case 4, and gear case 5. The drive shaft 47 rotatably drives the propeller 6 by way of a gear mechanism 48 and an output shaft 49 inside the gear case 5.

A combustion chamber 40*d* is formed by the engine head 40*a* and engine main body 40*b*. An exhaust channel 51 is in communication with the exhaust port of the combustion chamber 40*d*. An exhaust port 51*a* of the exhaust channel 51 extends to the vicinity of the vertically intermediate portion inside the extension case 4. The interior of the extension case 4 is an expansion chamber E.

A buoyant member 20 for preventing the stern S1 shown in FIG. 1 from dipping into the water when the boat is at a standstill and when the hull S is accelerating is mounted from the upper portion of the undercover 3 to the lower portion of the extension case 4 of the outboard engine 1 so as to encompass the external periphery of these components. The buoyant member 20 is mounted separately from the undercover 3. The front end portion 20*f* of the buoyant member 20 is positioned so as to protrude forward from the front end of the extension case 4, and the rear end portion 20*g* is positioned so as to protrude rearward beyond the propeller 6 and the rear end 10*a* of the anti-cavitation plate 10.

The buoyant member 20 has left and right buoyant member halves 21L and 21R divided on the left and right, as shown in FIG. 2. The right and left buoyant member halves 21L and 21R are mounted on the undercover 3 and extension case 4 by being joined together.

The lowest position B (referred to in the description below as "bottom") of the engine room R is formed by the undercover 3 and mounting case 45, as shown in FIG. 3. The buoyant member 20 has a lower surface wall 20*h* positioned further below the undercover 3, and has a closed space. The closed space has a voluminous portion that displaces water and imparts buoyancy to the outboard engine 1.

The structure of the buoyant member 20 is described next with reference to FIGS. 4, 5, and 6. The left and right buoyant members 21L and 21R have left and right symmetrical shapes.

Figure 4:
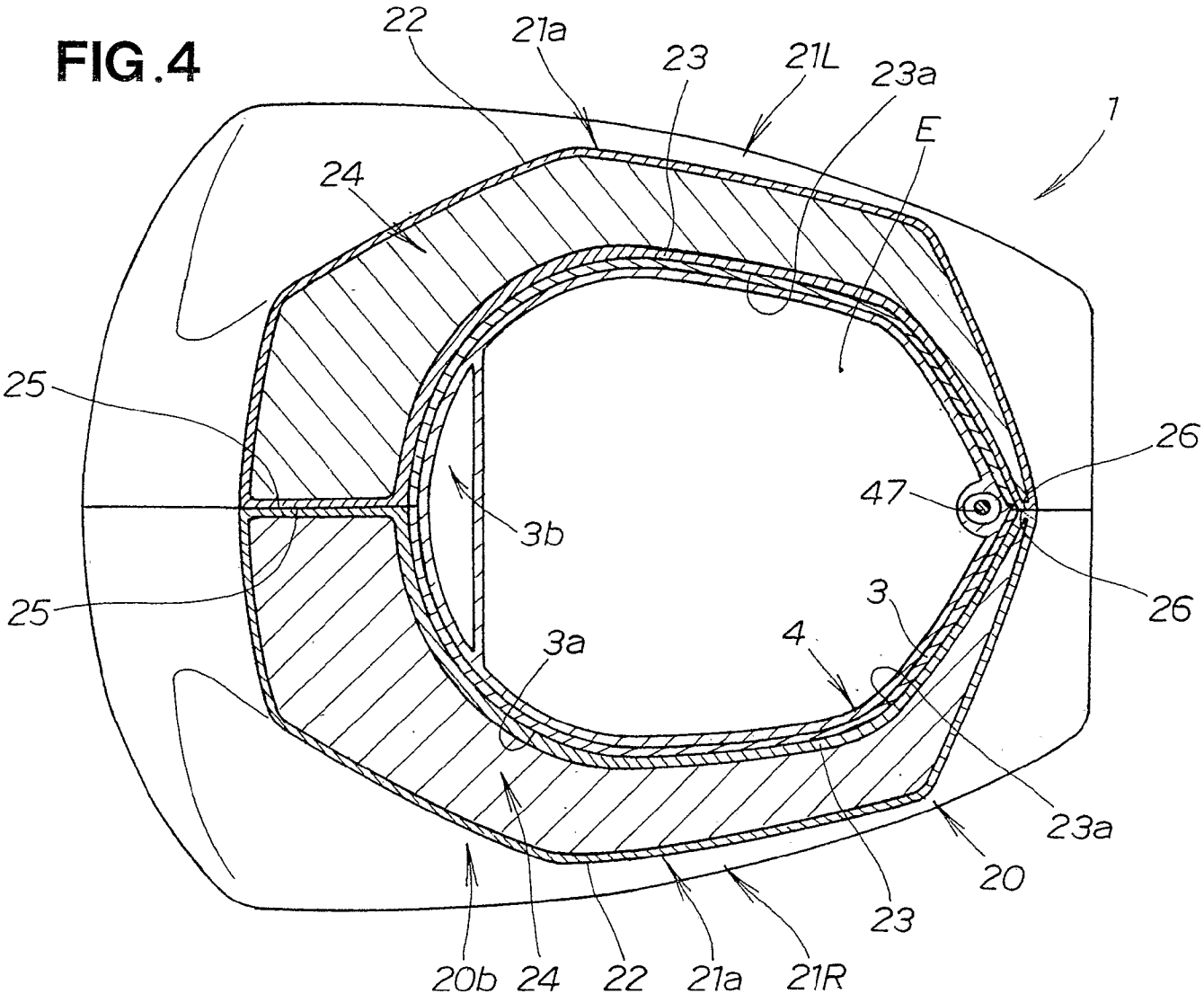
FIG. 4 is a cross-sectional view taken along line 4-4 of FIG. 1.

FIG. 4 shows a cross-section of the upper portion of the buoyant member 20. The longitudinal dimension of the upper portions 21*a* and 21*a* of the left and right buoyant members 21L and 21R is less than the longitudinal dimension of the intermediate and lower portions in the vertical direction shown in FIGS. 5 and 6.

The buoyant member halves 21L and 21R have a curved shape, in which the inner portion is concaved and the outer portion bulges outward. The buoyant member halves 21L and 21R have an external wall 22 and an internal wall 23, and the walls 22 and 23 form a closed space. A buoyancy-imparting filler material 24, e.g., styrene foam, fills the closed space. A foam material that is composed of various resins, is lightweight, and has a lower specific gravity than water can be used as the foam material 24. The walls 22 and 23 may be continuously formed with the same member as the foam material 24. In this case, the extent of foaming of the foam inside the foam material 24 may be increased and made greater than the extent of foaming in the area of the inner wall and/or the vicinity of outer wall.

The inner surfaces 23*a* and 23*a* of the internal walls 23 and 23 are in close contact along the outer surface 3*a* of the undercover 3. The upper portion of the extension case 4 is positioned inside the undercover 3. The left and right buoyant member halves 21L and 21R have front and rear butted joint surfaces 25, 25, 26, and 26. The rear joint surface 25 is longer than the front joint surface 26 in the front/rear direction.

The width of the longitudinally intermediate portion in the upper portion 20*b* of the buoyant member 20 is greater than the width of the front and rear portions, and the intermediate portion has a shape that bulges outward to the two sides.

Figure 5:
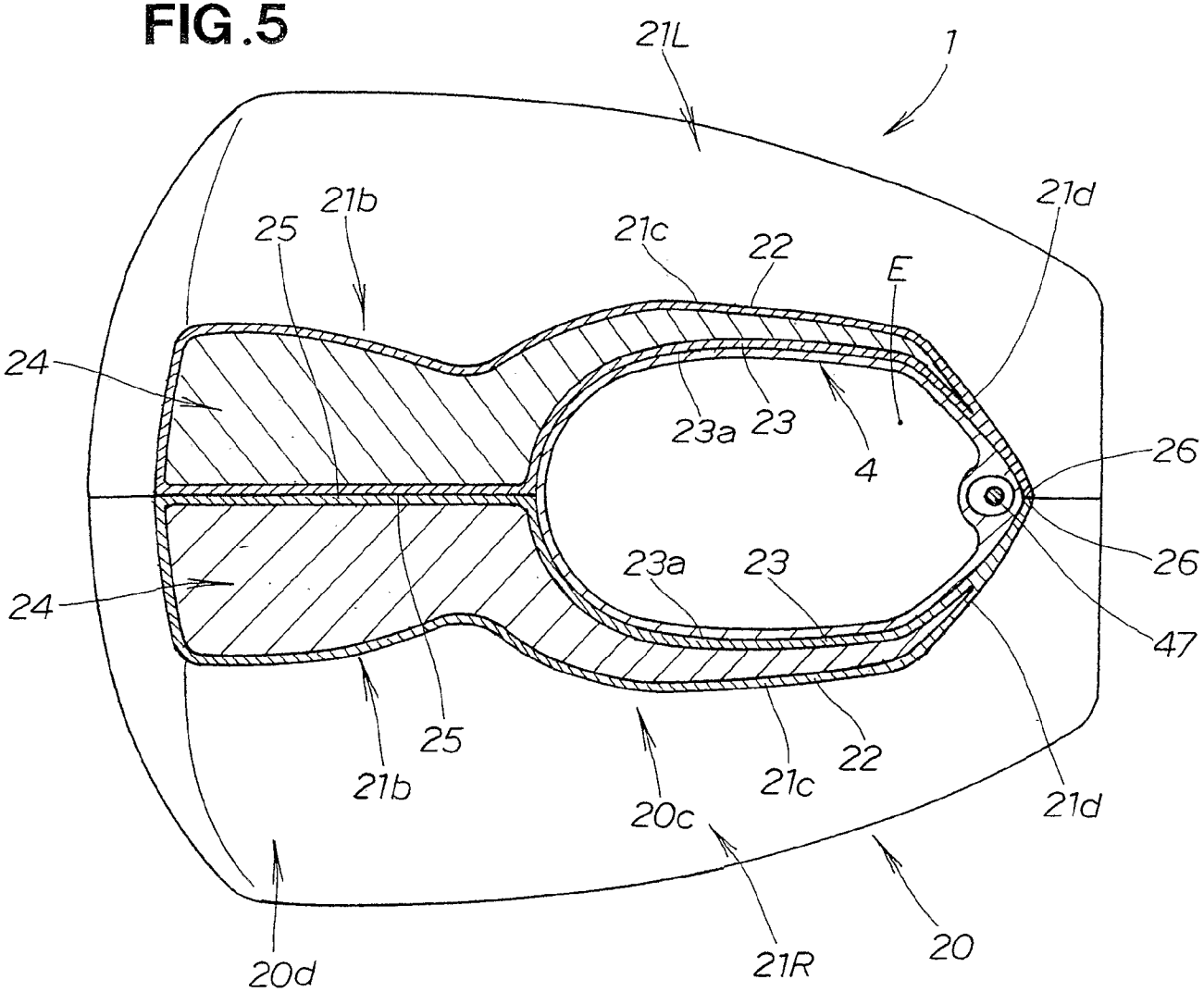
FIG. 5 is a cross-sectional view taken along line 5-5 of FIG. 1.

FIG. 5 shows a cross-section of the intermediate portion of the buoyant member 20 and extension case 4.

The rear portions 21*b* and 21*b* of the left and right buoyant member halves 21L and 21R in the vertically intermediate portion 20*c* of the buoyant member 20 have longitudinally extended joint surfaces 25 and 25 and are joined at the joint surfaces 25 and 25. The outer surface of the extension case 4 is in close contact with the inner surfaces 23*a* and 23*a* of the internal walls 23 and 23 of the left and right buoyant member halves 21L and 21R in the vertically intermediate portion 20*c* of the buoyant member 20.

The width gradually narrows from the intermediate portions 21*c* and 21*c* of the buoyant member halves 21L and 21R to the front portions 21*d* and 21*d*, and the left and right buoyant member halves 21L and 21R merge in the area of the front end joint surfaces (joint edges) 26 and 26.

Figure 6:
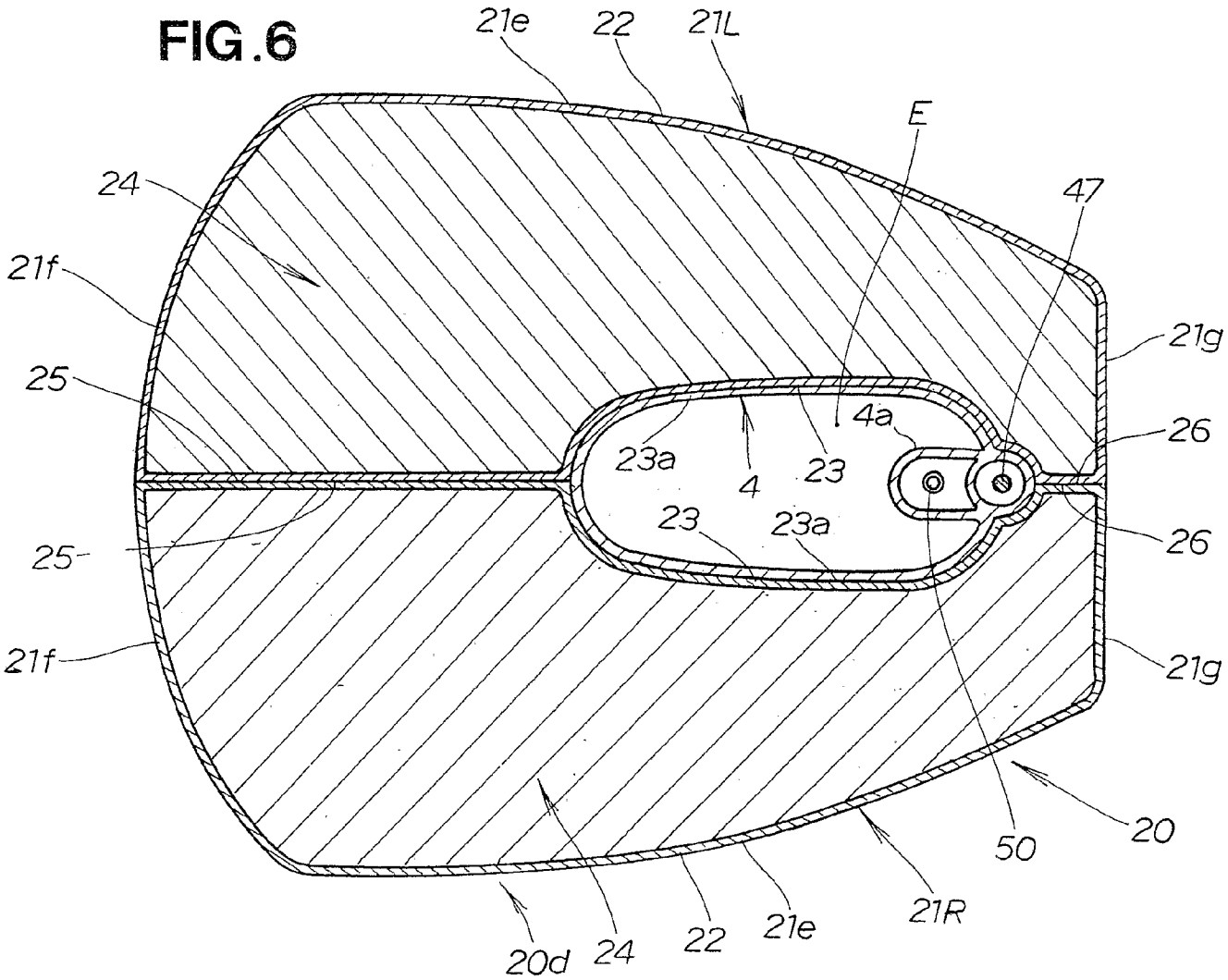
FIG. 6 is a cross-sectional view taken along line 6-6 of FIG. 1.

FIG. 6 shows a cross section of the lower portion area of the buoyant member 20.

The two external side surfaces 21*e* and 21*e* of the left and right buoyant member halves 21L and 21R extend slightly outward in the lower portion 20*d* of the buoyant member 20. The rear surfaces 21*f* and 21*f* are curved so that the joint surfaces 25 and 25 extend rearward in a joined state. The front surfaces 21*g* and 21*g* are flat when the joint surfaces 26 and 26 are joined.

A sub-expansion chamber 3*b* for idling is in communication with the outside air port (not shown), as shown in FIG. 4.

The drive shaft 47 is connected to the crankshaft 41 of the engine 40, as shown in FIGS. 3 to 6, and is vertically disposed so as to drive the propeller 6.

A water feed tube 50 for cooling the engine vertically passes through the interior of a partitioned dividing wall 4*a*, as shown in FIG. 6. The interior of the extension case 4 is an exhaust expansion chamber E.

In this manner, the buoyant member 20 is disposed on the external periphery of the extension case 4 from the undercover 3. The upper end 20*a* of the buoyant member 20 is designed so as to be positioned slightly lower than the lower end edge 2*a* of the engine cover 2, as shown in FIG. 1.

The lower portion 20*d* of the buoyant member 20 shown in FIG. 6 is wider than the upper portion 20*b* and intermediate portion 20*c*, and the amount of protrusion is greatest in the rearward direction and is least in the forward direction.

The shape of the lower surface 30 of the buoyant member 20 is described next in detail with reference to FIG. 1.

Referring to FIG. 1, the lower surface 30 of the buoyant member 20 has a front half portion 31 that rectilinearly slopes downward at a gradual angle from the longitudinally intermediate portion 30*b* toward the front portion 30*a*, and, a sloped surface 32 of the rear portion that slopes downward and rearward from the curved portion 33, which is in the highest position of the front half 31. The lower surface is curved in the form of a dogleg as viewed from the side.

The front half 31 includes an extended portion 30*f* that extends so as to protrude forward from the front end 5*a* of the case 5. The front half 30*c* of the lower surface 30 is the front end of the extended portion 30*f*. In other words, the front half 31 of the lower surface linearly extends rearward from the forward area the extension case 4. The rearward position of the extension case 4 is a position that is slightly more rearward than the rear portion 10*a* of the anti-cavitation plate 10.

The curved portion 33 of the lower surface 30 is positioned slightly more rearward than the rear portion 10*a* of the anti-cavitation plate 10 and is formed on the rear end portion at the highest position of the front half 31.

The rear portion 30*d* of the lower surface 30 extends downward and rearward from the curved portion 33. The rear portion 30*d* is designed to be shorter than the length of the front half 31 of the lower surface 30. The front end portion of the rear portion 30*d* is the curved portion 33 and is the highest position of the rear portion. The rear end portion 30*e* of the rear portion 30*d* is the lowest position and is in a lower position than the front end portion 30*c* of the lower surface 30. Specifically, the rear portion 30*d* has a sloped surface 32 of the rear portion that slopes downward from the curved portion 33 in the rearward direction of the rear end portion 30*e*.

The slope angle of the sloped surface 32 of the rear portion, i.e., the angle θ formed by the sloped surface 32 of the rear portion with respect to the horizontal plane, is preferably in a range of $0° \leqq \theta \leqq 45°$. In the example, the angle θ formed by the line P1 of the horizontal plane and the line P2 is substantially 30°.

The curved portion 33, which forms the front end portion of the sloped surface 32 of the rear portion of the lower surface 30 of the buoyant member 20, is positioned further rearward than the line P3 that connects the lower surface 30 and the rear end portion 10*a* of the anti-cavitation plate 10.

The width of the buoyant member 20 is naturally greater than the width of the anti-cavitation plate 10 and the anti-splash plate 9, and is sufficiently greater than the rotational path of the propeller 6, as shown in FIG. 2.

The buoyant member 20 is disposed outside the engine room formed by the engine cover 2. The depth of the stern S8 is reduced by the static buoyancy of the buoyant member 20 when the boat is at a standstill, and the tilt of the hull S is reduced. When the boat is moving at low speed as well, the buoyancy of the buoyant member 20 reduces the depth and tilt of the stern, and the tilt of the hull S is corrected to be nearly horizontal. The time required for the boat to exceed a threshold, i.e., to overcome bow waves, can therefore be shortened and smooth acceleration can be achieved by resisting and reducing a lower depth in the water during acceleration by an amount proportional to the proximity of the orientation to horizontal direction of the hull S (orientation at the threshold) brought about by the buoyancy of the buoyant member when the boat is accelerating from low-speed travel. The buoyant member 20 appears above the waterline after acceleration, water resistance is therefore not produced during travel, and high speed maneuverability is not compromised.

A buoyancy means is formed by the wall of a buoyant member that is separate from the undercover 3 that forms the engine room R. Therefore, the engine room R is not required to be disposed below the waterline, and the engine room R is not liable to flood.

The buoyant member 20 can keep the undercover 3 above the waterline, and a water drain from the engine room R can be disposed above the waterline.

Given that the lower surface 30 of the buoyant member 20 has the above-described configuration, the stern S1 is lifted upward by the lifting force that is generated by the difference in pressure between the upper and lower surfaces of the sloped surface 32 of the rear portion when the hull S is propelled. This result is achieved because the lower surface in particular has a sloped surface 32 in the rear portion that is curved in the shape of a dogleg upward and rearward of the rear end portion 10*a* of the cavitation plate 10 and propeller 6.

As described above, the lower surface 30 of the buoyant member 20 has a front half portion 31 that has a rectilinear surface that slopes upward at a gradual angle in the rearward direction, but the rear portion 30*d* is a sloped surface 32 of the rear portion that rapidly slopes downward and rearward, and therefore forms an angle of attack. Propulsion is started in this state and the boat moves forward. Lifting force that provides an upward lift from the downward direction thereby operates on the buoyant member 20 in addition to the buoyancy of the buoyant member 20 itself. Propulsion therefore provides efficient lift together with the buoyancy produced by the buoyant member 20, and the hull S smoothly and rapidly transitions to horizontal travel.

In the first example, the lower surface 30 of the buoyant member 20 has lower surfaces (lower surfaces 31 and 32 comprising 30*a*, 30*c*, and 30*d*) that are higher and wider than the anti-cavitation plate 10.

Therefore, a splash-reducing effect can be obtained in which the upward splashing of water, i.e., the upward spewing of water caused by the rotation of the propeller 6, is effectively reduced by the lower surface 30 of the buoyant member 20, which has a voluminous portion that displaces water.

The buoyant member 20 is provided with two functions, i.e., a buoyancy function and an anti-splash function. The buoyant member having an anti-splash function can be integrally formed or retrofitted to the outboard engine 1.

The lower surface 30 of the buoyant member 20 has an extended portion 30*f* that extends further forward than the front end 5*a* of the extension case (drive shaft case) 4, and upward splashing can therefore be effectively reduced.

In the first example above, the front half 31 of the lower surface 30 of the buoyant member 20 is given a gradually downward forward slope, but the front half 31 may naturally also be horizontal. The front half 31 of the lower surface 30 may furthermore be given a gradually rising surface, and the rear portion 30*d* may be rapidly sloped rearward and downward in comparison with the sloped surface of the front half 31, and may serve as the sloped surface 32 of the rear portion.

The filler material of the buoyant member is not limited to the material described above, and a material may also be used that has a hollow interior and that provides rigidity to the inner and outer walls of the buoyant device. When importance is placed on its function as a noise reduction cover, the noise reduction cover may be formed from a thick sheet member. It is also possible to select a material with a high noise-absorbing effect as the filler material.

A second example of the outboard engine is described next with reference to FIGS. 7 to 9.

The outboard engine 1 of the second example differs only in the shape of the buoyant member 20, and the configuration of other components is the same. Therefore, the same reference numerals are assigned to the same components as those in the first example, and a description thereof is omitted.

Figure 7:
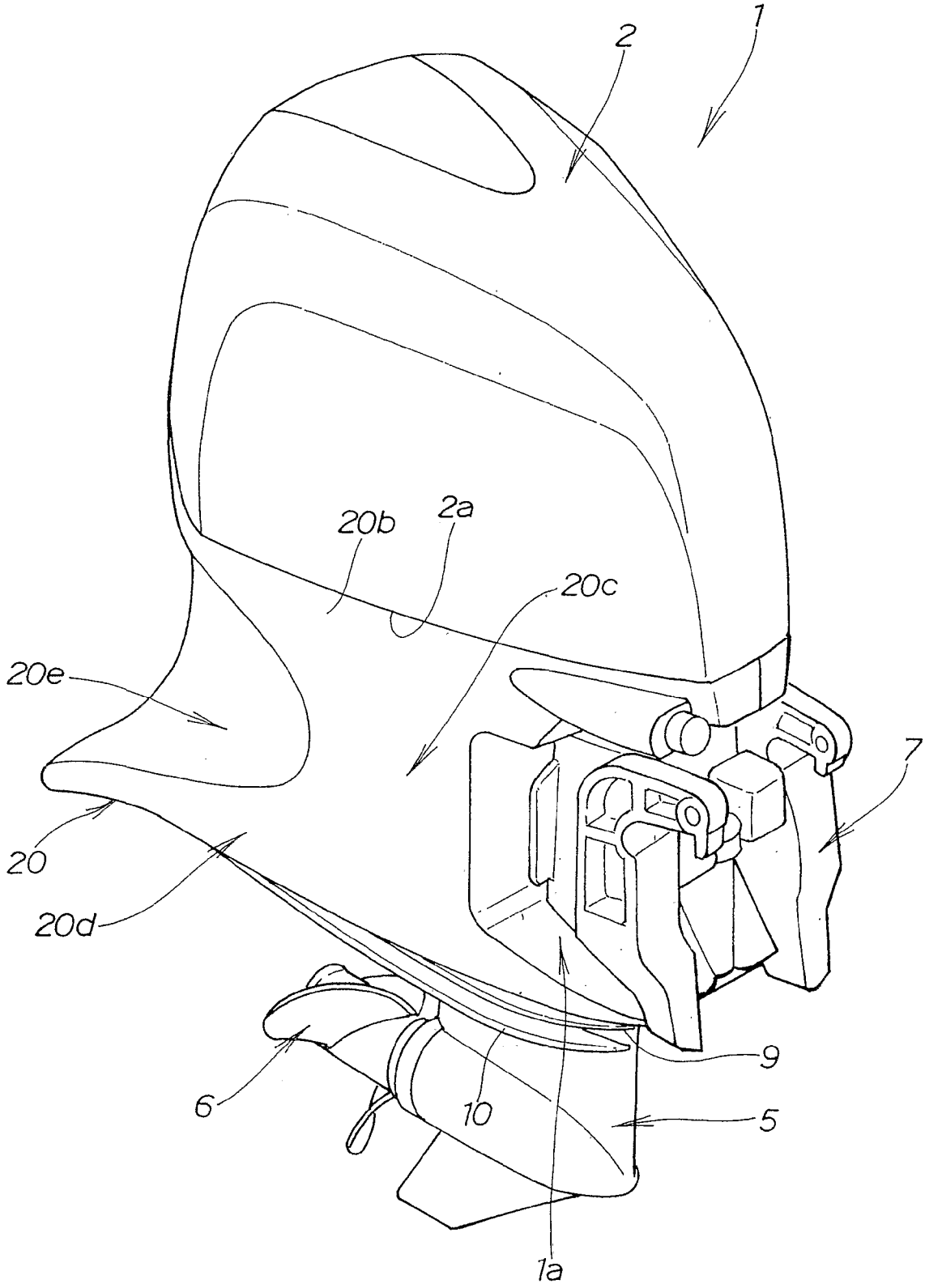
FIG. 7 is a perspective view of an outboard engine according to a second embodiment of the present invention.
Figure 8:
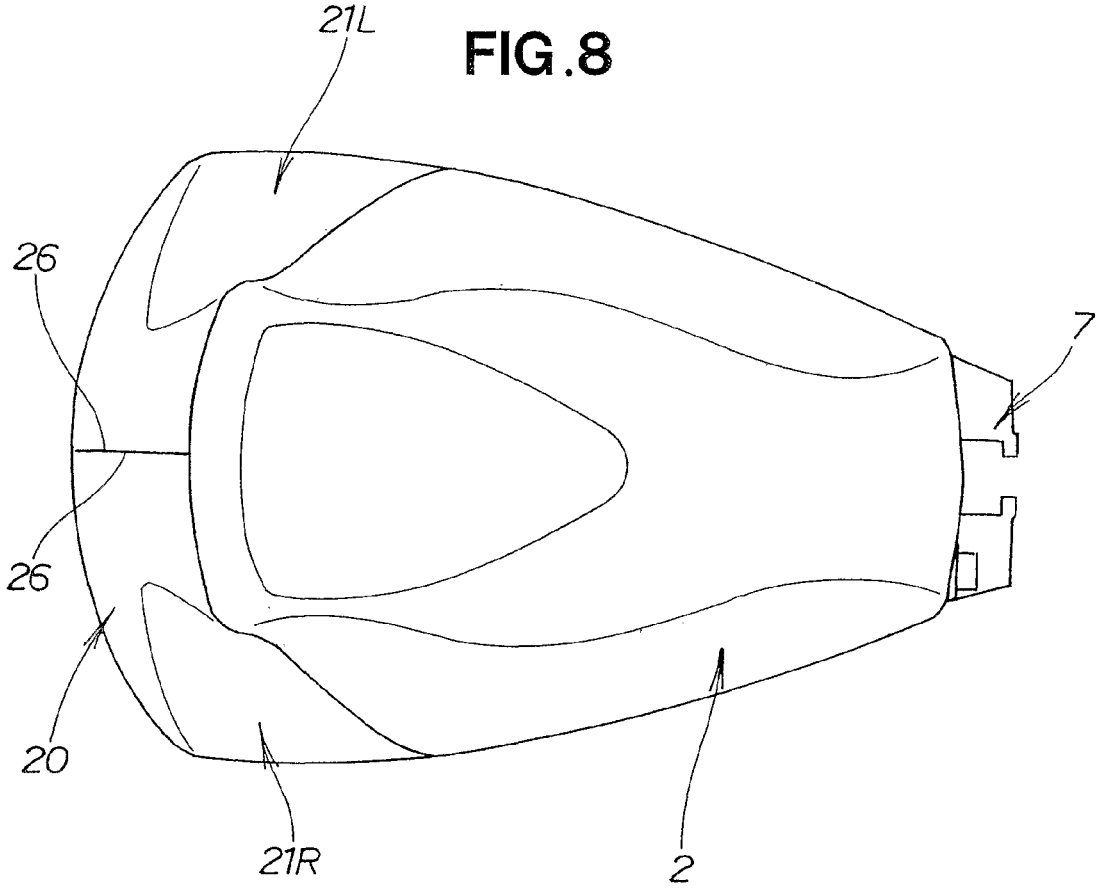
FIG. 8 is a plan view of the outboard engine shown in FIG. 7.
Figure 9:
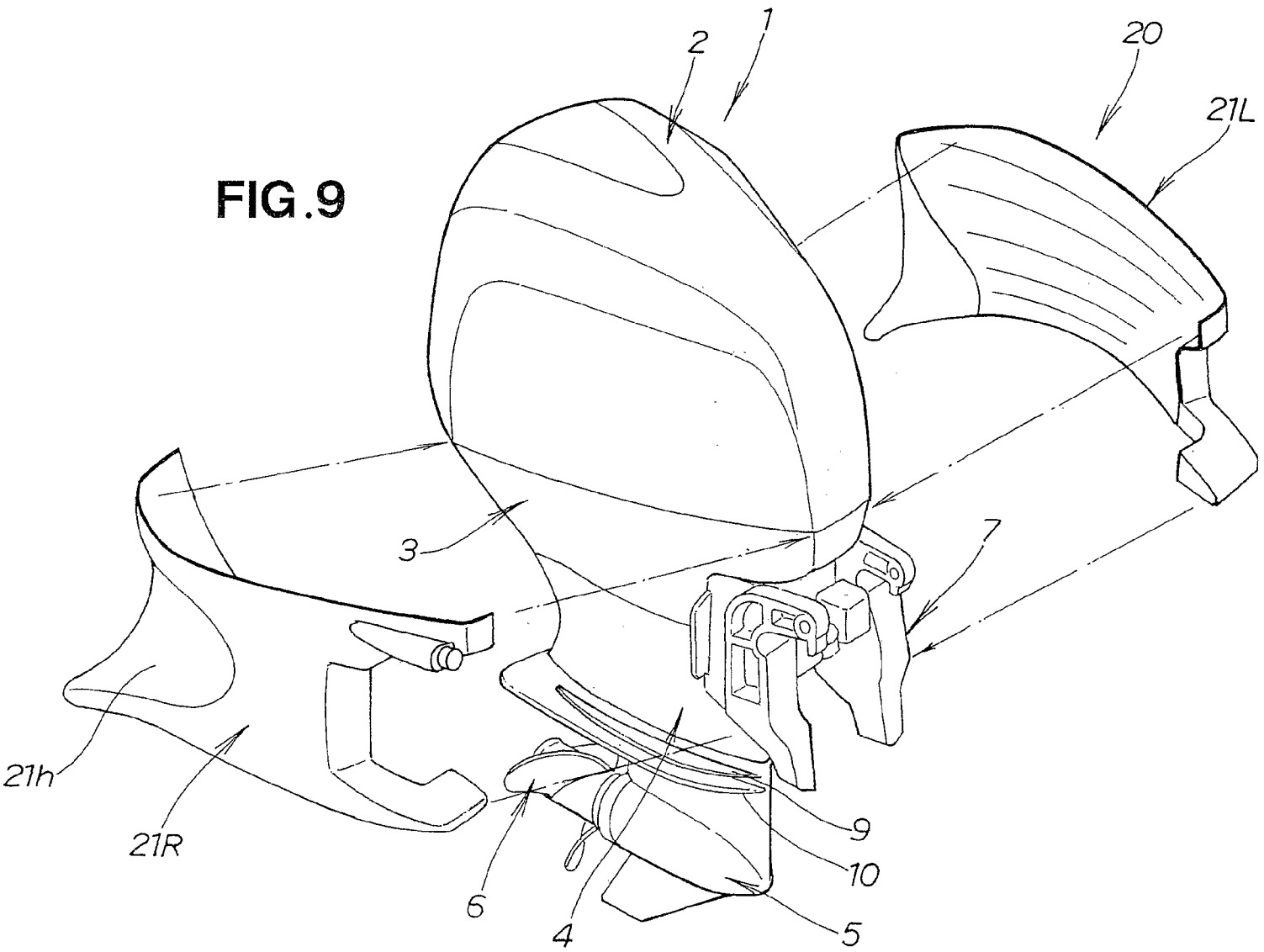
FIG. 9 is an exploded perspective view of the outboard engine shown in FIG. 7.

The two sides of the vertically intermediate portion of the rear portion of the buoyant member 20 of the second example have a concavity 20*e* formed substantially in a V-shape that vertically widens in the rearward direction, as shown in FIGS. 7 to 9. The concavity 20*e* is symmetrically formed as a concavity 21*h* (only one is shown) in the intermediate portion of the rear portion of the left and right buoyant member halves 21L and 21R. The concavity 20*e* of the buoyant member 20 reduces water resistance when the boat accelerates from a standstill.

Figure 10:
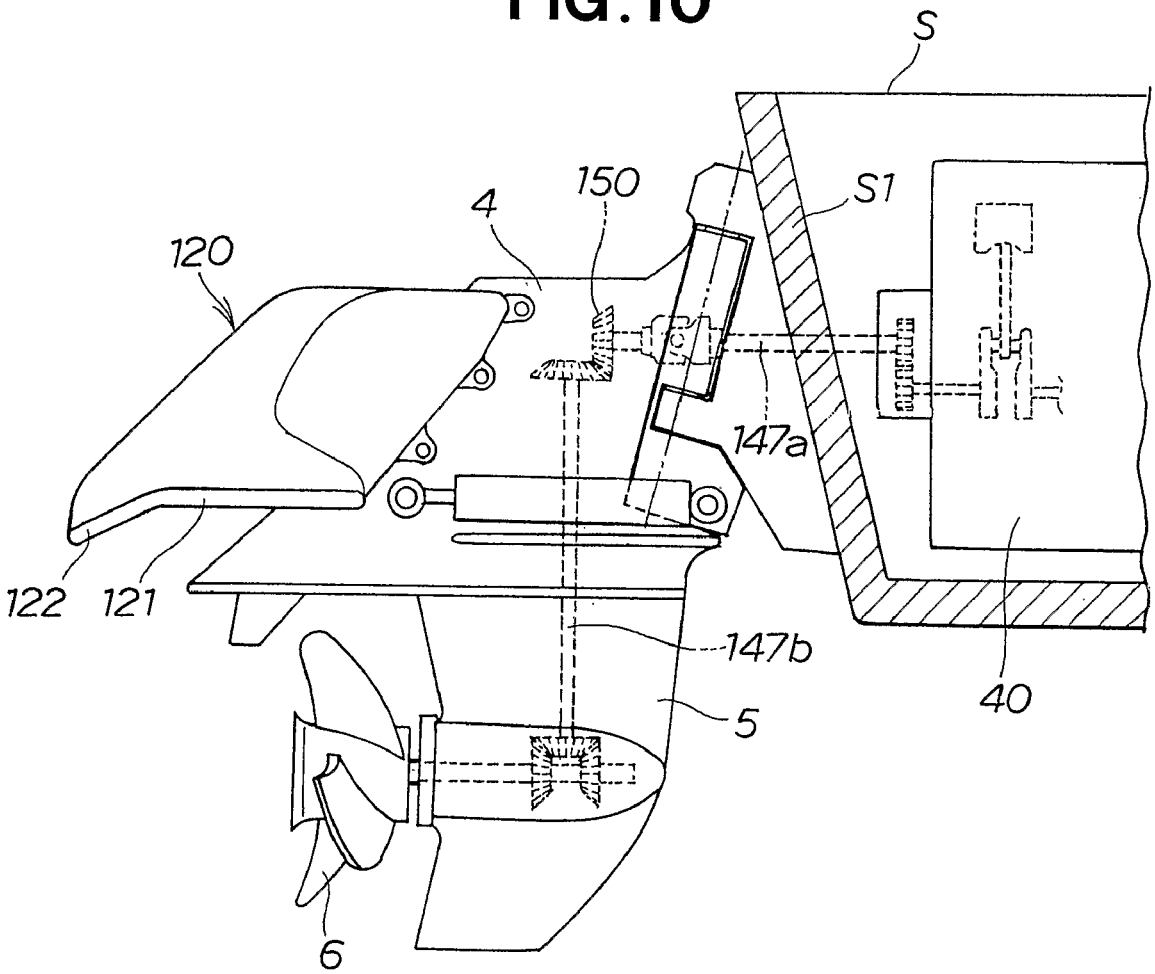
FIG. 10 is a diagram showing a boat propulsion engine of the third example, and shows an example in which the engine is disposed inside the hull.

FIG. 10 shows another example of a boat propulsion engine, and shows an example of an inboard engine in which an engine 140 is accommodated in the hull S. The same reference numerals are used for the same members as in the outboard engine shown in the first and second examples, and a detailed description of, the members is omitted.

According FIG. 10, the engine 140 is accommodated in the hull S. A first drive shaft 147*a* from the engine 140 extends horizontally so as to externally protrude in the rearward direction from the stern S1. The first drive shaft 147*a* is connected to a second drive shaft 147*b* by way of a gear mechanism 150. The second drive shaft 147*b* vertically passes through the inside of a gear case 5 and an extension case 4. A propeller 6 is rotated by the second drive shaft 147*b*.

A buoyant member 120 based on an example that is different than the first and second example is mounted on the rear portion of the extension case 4. The buoyant member 120 comprises a substantially horizontally formed front half 121 and a rear portion 122 having a surface that slopes downward in the rearward direction. In other words, the lower surface of the buoyant member 120 is curved in a dogleg shape.

In addition to the buoyancy of the buoyant member 120 itself, the sloped surface formed on the rear portion 122 has the effect of lifting the stern S1 in the upward direction when the boat accelerates from a standstill. The effect is provided in the same manner as the effect of the sloped surface of the rear portion of the first example shown in FIG. 1. The stern S1 is rapidly lifted up, and the hull S smoothly reaches a horizontal orientation during acceleration.

INDUSTRIAL APPLICABILITY

The boat propulsion engine of the present invention is useful as an outboard engine that imparts buoyancy to the propulsion engine, allows the hull to smoothly and rapidly transition to high speed travel in the initial stage of propulsion, and reduces the exhaust noise of the engine.

The invention claimed is:

1. An outboard engine, comprising:

a propeller;

a case body, said case body being pivotable with respect to a transom of a boat and about a substantially vertical axis for controlling direction of travel of the boat, wherein the case body is disposed near the transom of the boat and houses a substantially vertical drive shaft that drives the propeller;

a buoyant member that is buoyant at least at standstill in still water, wherein the buoyant member is disposed on the case body and includes a lower surface formed on a rear portion of said buoyant member, said lower surface disposed below an engine room and opposite the propeller, said lower surface sloping downwardly and rearwardly with respect to the drive shaft housed in the case body; and wherein said buoyant member pivots with the case body about said substantially vertical axis.

2. The outboard engine of claim 1, wherein the lower surface of the rear portion has a sloping angle with respect to a horizontal plane in a range of 0 degree to 45 degrees.

3. The outboard engine of claim 1, further comprising:

an anti-cavitation plate disposed above the propeller, the buoyant member further including a sloped surface formed on a front portion of said buoyant member, wherein the sloped surface is disposed above and at a distance from the anti-cavitation plate.

4. The outboard engine of claim 3, wherein said buoyant member further comprises a curved surface disposed intermediate said lower surface of the rear portion and the sloped surface formed on the front portion.

5. The outboard engine of claim 4, wherein the curved surface is positioned further rearwardly with respect to a rear end portion of the anti-cavitation plate.

6. An outboard engine, comprising:

a propeller;

an anti-cavitation plate disposed above the propeller;

a case body, said case body being pivotable with respect to a transom of a boat and about a substantially vertical axis for controlling direction of travel of the boat, wherein the case body is disposed near the transom of the boat and houses a substantially vertical drive shaft that drives the propeller, and wherein said case body supports said anti-cavitation plate;

a buoyant member that is buoyant at least at standstill in still water, wherein the buoyant member is disposed on the case body and has a lower surface that is formed on a rear portion of said buoyant member, said lower surface disposed below an engine room and above the anti-cavitation plate, wherein said buoyant member is wider than the anti-cavitation plate; and wherein said buoyant member pivots with the case body about said substantially vertical axis.

7. The outboard engine of claim 6, wherein the lower surface of the rear portion has a sloping angle with respect to a horizontal plane in a range of 0 degree to 45 degrees.

8. The outboard engine of claim 6, wherein the lower surface of the buoyant member has an extended portion that extends further forward than a front end portion of the case body.

9. An inboard-outboard engine, comprising:

a propeller, said propeller arranged to be powered by an engine disposed within a hull of a boat;

a case body, said case body being pivotable with respect to a transom of the boat and about a substantially vertical axis for controlling direction of travel of the boat, wherein the case body is disposed near the transom of the boat and houses a substantially vertical drive shaft that drives the propeller;

a buoyant member that is buoyant at least at standstill in still water, wherein the buoyant member is disposed on the case body and includes a lower surface formed on a rear portion of said buoyant member, said lower surface disposed substantially behind the engine and opposite the propeller, said lower surface sloping downwardly and rearwardly with respect to the drive shaft housed in the case body; and wherein said buoyant member pivots with the case body about said substantially vertical axis.

10. The inboard-outboard engine of claim 9, wherein the lower surface of the rear portion has a sloping angle with respect to a horizontal plane in a range of 0 degree to 45 degrees.

11. The inboard-outboard engine of claim 9, wherein said buoyant member further comprises a curved surface disposed at a front end of said lower surface of the rear portion.

12. The inboard-outboard engine of claim 11, wherein the curved surface is positioned further rearwardly with respect to a rear end portion of the anti-cavitation plate.

13. An inboard-outboard engine, comprising:

a propeller, said propeller arranged to be powered by an engine disposed within a hull of a boat;

an anti-cavitation plate disposed above the propeller;

a case body, said case body being pivotable with respect to a transom of the boat and about a substantially vertical axis for controlling direction of travel of the boat, wherein the case body is disposed near the transom of the boat and houses a substantially vertical drive shaft that drives the propeller, and wherein said case body supports said anti-cavitation plate;

a buoyant member that is buoyant at least at standstill in still water, wherein the buoyant member is disposed on the case body and has a lower surface that is formed on a rear portion of said buoyant member, said lower surface disposed substantially behind the engine and above the anti-cavitation plate, wherein said buoyant member is wider than the anti-cavitation plate; and wherein said buoyant member pivots with the case body about said substantially vertical axis.

14. The inboard-outboard engine of claim 13, wherein the lower surface of the rear portion has a sloping angle with respect to a horizontal plane in a range of 0 degree to 45 degrees.

* * * * *